United States Patent [19]

Schneider et al.

[11] 4,013,538

[45] Mar. 22, 1977

[54] DEEP SUBMERSIBLE POWER ELECTRODE ASSEMBLY FOR GROUND CONDUCTION OF ELECTRICITY

[75] Inventors: Harold N. Schneider, Springfield; Charles H. Titus, Newtown Square; J. Kenneth Wittle, Berwyn, all of Pa.

[73] Assignee: General Electric Company, Philadelphia, Pa.

[22] Filed: Dec. 22, 1971

[21] Appl. No.: 211,010

[52] U.S. Cl. ..... 204/280; 166/65 R; 166/248; 174/9 F; 204/282; 204/286

[51] Int. Cl.[2] ..... C25B 11/00; E21B 43/00

[58] Field of Search ..... 166/65 R, 248; 174/9 F; 204/196, 197, 280, 282, 283, 286

[56] References Cited

UNITED STATES PATENTS

| | | | |
|---|---|---|---|
| 550,319 | 11/1895 | Diatto | 174/9 F |
| 928,963 | 7/1909 | Gugler | 174/9 F |
| 1,784,214 | 12/1930 | Workman | 166/248 |
| 2,244,322 | 6/1941 | Zoller | 204/197 |
| 2,872,405 | 2/1959 | Miller et al. | 204/290 F |
| 2,976,226 | 3/1961 | Risberg | 204/196 |
| 3,391,072 | 7/1968 | Pearson | 204/197 |
| 3,457,152 | 7/1969 | Maloney et al. | 204/280 |
| 3,530,936 | 9/1970 | Gunderson et al. | 166/248 |
| 3,616,354 | 10/1971 | Russell | 204/196 |
| 3,616,421 | 10/1971 | MacKintosh | 204/197 |

*Primary Examiner*—T. Tung
*Attorney, Agent, or Firm*—William Freedman

[57] ABSTRACT

An underground electrode adapted for ground conduction of electric current in an environment of saline and oleaginous fluids and under high hydrostatic pressure comprises a hollow tubular electrode having a cable terminal at its upper end and affixed to the lower end of an insulating cable conduit. A fluid supply conduit surrounding the cable conduit supports a permeable enclosing basket which surrounds the electrode and controls flow of fluid electrolyte over its surface.

20 Claims, 7 Drawing Figures

DEEP SUBMERSIBLE POWER ELECTRODE ASSEMBLY FOR GROUND CONDUCTION OF ELECTRICITY

Our invention relates to deep submersible power electrodes for ground conduction of electric current, and particularly to a power-conveying anode assembly. The invention is especially applicable to high voltage, high current anodes in apparatus for the conduction of electricity through earth formations, as in secondary oil recovery operations or other treatment of oil bearing strata. The following published prior art is representative of that now known to applicants: U.S. Pat. Nos. 2,751,194-Rohrback et al; 2,597,261-Rhoads; 3,141,504-Sarapuu.

Various electro-thermal techniques which involve the conduction of electric current through ground have been proposed heretofore to facilitate recovery of oil from underground oil-bearing formations. One such technique which comprehends conduction of high unidirectional power current at high voltage between spaced-apart ground electrodes is illustrated in the copending application Ser. No. 196,917 filed on Nov. 9, 1971 by C. W. Bell and C. H. Titus and assigned to the same assignee as the present application, now U.S. Pat. No. 3,782,465. In that copending application there is disclosed but not claimed a high voltage underground electrode suitable for immersion in a moving stream of electrolytic fluid under high hydrostatic pressure. The present application is directed more particularly to the structure of such an electrode and its assembly with a control and protective enclosure of novel and cooperative design.

Accordingly, it is a general object of our present invention to provide an improved high-power underground electrode, and particularly an anode, capable of carrying high unidirectional current over extended time periods in a chemically hostile environment and under high ambient pressure.

It is another object of our invention to provide a deep submersible underground electrode having a hydrostatically balanced internal cable connection designed to equalize internal and external pressures upon the electrode.

It is still another object of our invention to provide improved current control and protective means for a high-power underground electrode adapted to be deeply submerged in a chemically hostile environment.

A still further object of our invention is to provide an electrode assembly comprising a high power current conducting electrode having an elongate configuration and a permeable protective enclosure designed to direct a lengthwise flow of electrolytic cooling fluid over the electrode surface to control current density and promote cooling.

In carrying out our invention in one preferred embodiment, we provide an elongate tubular electrode assembly primarily adapted for operation, as a high voltage anode, in a deep borehole which penetrates an oil-bearing earth formation. The electrode is designed for suspension at the lower end of electric power cable which is enclosed for a substantial portion of its length above the electrode in a conduit carrying saline water for electrolytic conduction and cooling. To prevent oxidation and electrolytic corrosion in anodic operation the current carrying body of the electrode is plated with lead dioxide. Electric connection is made in the hollow interior of the electrode body by means of a stud or probe extending into a pool of liquid metal (at operating temperature) such as mercury. The mercury pool is maintained under pressure substantially equal to the external hydrostatic ambient by communication through insulating fluids with external pressurized fluid; a substantially equal hydrostatic pressure applied through the connecting cable and conduit balances conduit pressures on opposite ends of the connecting stud. To ensure that the cooling electrolyte bathes the entire surface of the elongate electrode, the electrode is enclosed in radially spaced relation in a concentric tubular enclosure which is permeable to the electrolytic fluid supplied to its interior but substantially impermeable to solid materials and oleaginous fluids in the surrounding earth formation.

Our invention will be more fully understood and its objects and advantages further appreciated by referring now to the following detailed specification taken in conjunction with the accompanying drawing, wherein.

Figure 1:
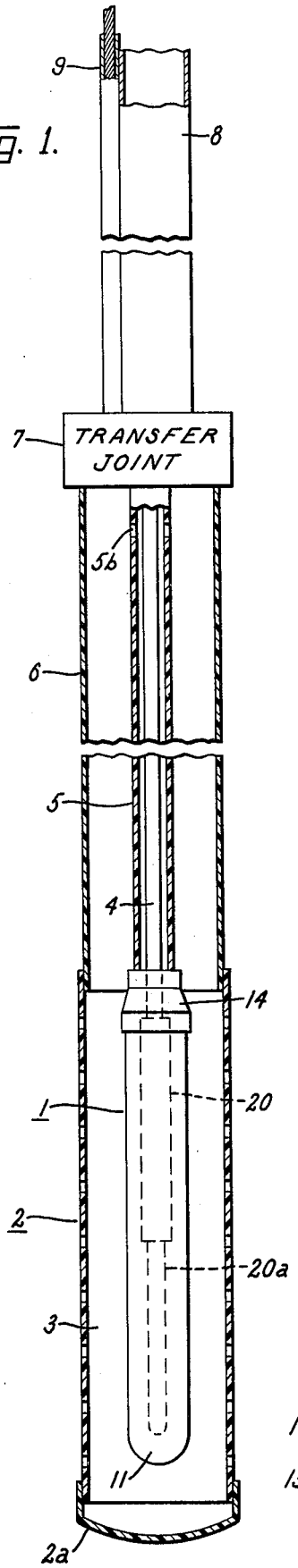
FIG. 1 is a side elevational view, partly in section, of an electrode assembly and connected fluid and electric current supply conduits embodying our invention.
Figure 2:
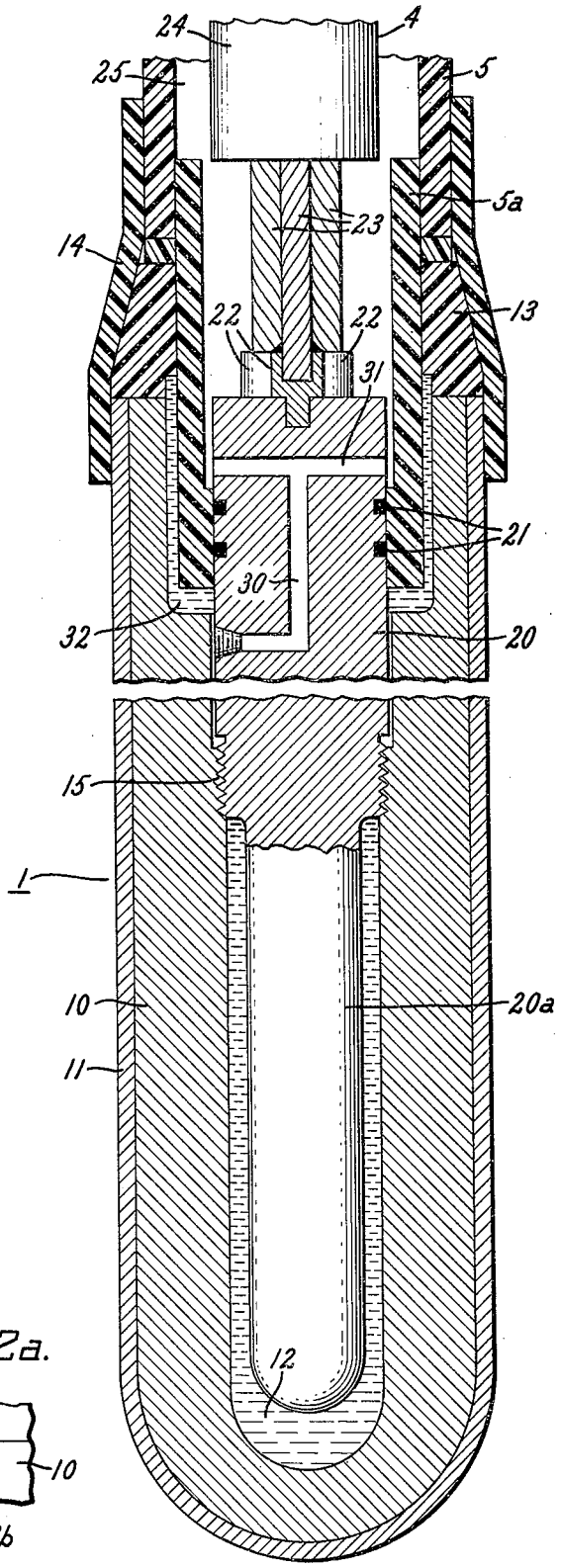
FIG. 2 is an axial cross sectional view showing internal structural features of the current carrying electrode and connected cable conduit illustrated more generally at FIG. 1.
Figure 2A:
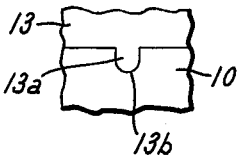
Figure 3:
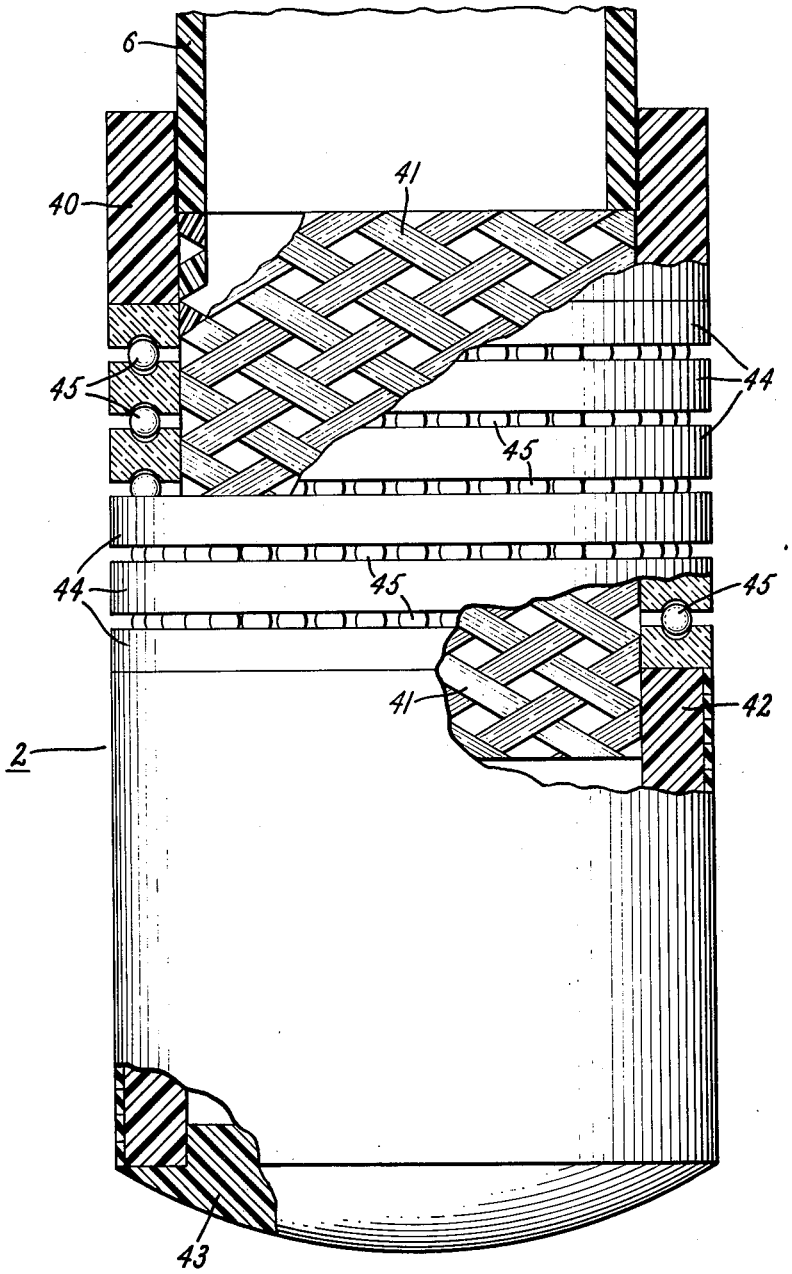
Figure 4:
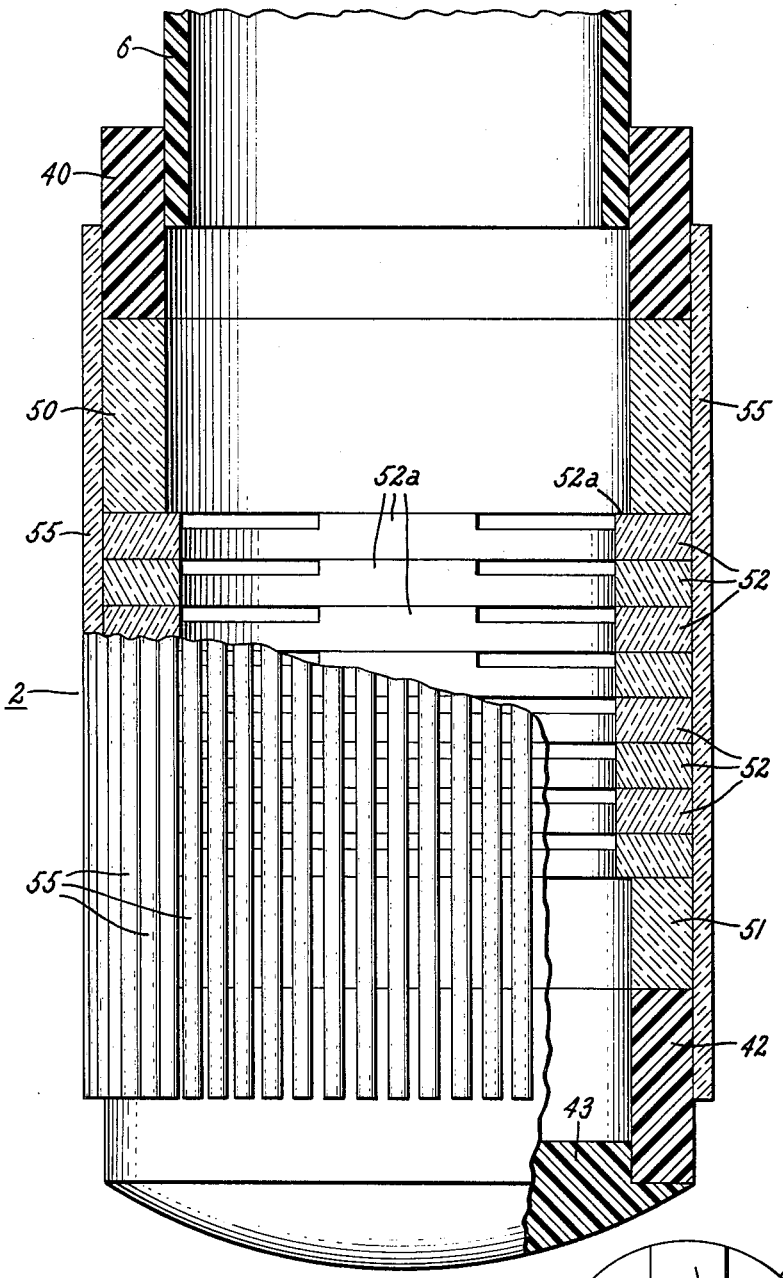
Figure 4A:
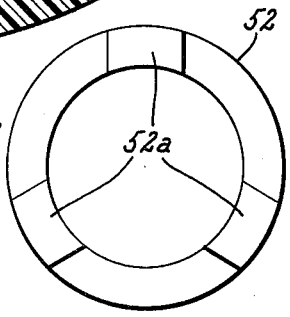
Figure 5:
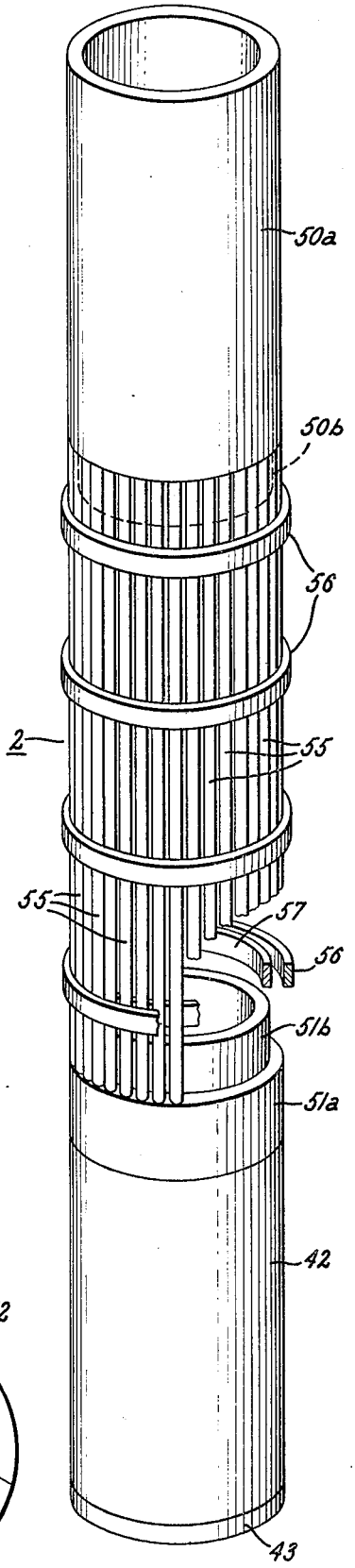

FIG. 2*a* is a fragmentary cross sectional view of a feature of the electrode cap shown at FIG. 2;

FIG. 3 is a side view, partly in section, of an electrode enclosure shown more generally at FIG. 1;

FIG. 4 is a side view partly in section, of another form of electrode enclosure;

FIG. 4*a* is a cross sectional view taken along the line 4—4 of FIG. 4; and FIG. 5 is a perspective view, partly broken away, showing still another form of electrode enclosure embodying our invention.

Referring now to the drawing, and particularly to FIG. 1, we have shown a ground electrode assembly comprising an elongated tubular current conducting electrode 1 and a coaxial tubular enclosure 2 of insulating material radially spaced apart to define therebetween an annular space 3. The main body of the enclosure 2 is provided with a plurality of small apertures or openings and its lower end is closed by an imperforate insulating cap 2*a*. The electrode 1 is suspended within the enclosure and above the end cap 2*a* by means of a current conducting cable 4 which is loosely positioned within a protective tube or conduit 5 formed of insulating material and extending a substantial distance vertically above the electrode 1. The cable conduit or tubing 5 extends through a larger fluid conduit 6 of insulating material to the lower end of which the fluid permeable electrode enclosure 2 is coupled in telescoping relation. At a substantial distance vertically above the electrode assembly 1, 2 the fluid conduit 6 and electric cable 4 pass through a transfer joint 7 at which the insulating cable conduit 5 is terminated and the cable emerges from the fluid conduit. Above the transfer joint 7 a metal fluid conduit 8 and metallic armored cable 9 extend in lateral juxtaposition to terminal points (not shown) above ground. The cable and fluid conduit transfer joint 7 and disposition of the anode and conduit in deep bore hole is more fully described and illustrated in applicants copending U.S. Pat. No. 3,674,912.

In a preferred embodiment of our invention having the general configuration illustrated at FIG. 1 and designed for anodic operation under high current and voltage conditions (i.e., 25 KW to 1,000 KW or more at voltages above 200 volts) and under high ambient hydrostatic pressure several thousand feet below the surface of the earth, we utilize an anode body 1 having a length of the order of 4 feet and a diameter of the order of two inches suspended about 60 feet below the transfer joint 7.

At FIG. 2 there is shown in greater detail the structure of the current conducting anode body 1 affixed to the lower end of the insulating cable conduit 5 and electrically connected to the conducting cable 4. The anode itself comprises an elongate hollow tubular shell 10 of electrically conducting material closed at its lower end. Preferably the tubular shell 10 is formed of graphite or of a metal having a temperature coefficient of expansion matching that of any external coating material which may be provided. For anodic operation it is desirable that the external surface of the graphite shell or substrate be coated with a material resistant to oxidation and electrolytic corrosion, and in a preferred embodiment of our invention the external surface of the graphite shell 10 is plated with one or more layers 11 of lead dioxide. The well, or cavity, formed at the closed lower end of the tubular shell 10 is threaded internally at 15 and partially filled with a body of mercury 12.

At its open upper end the anode 1 is mechanically connected to the lower end of the tubular insulating cable conduit 5. Preferably the cable conduit 5 is formed of glass fiber-filled epoxy resin. At its lower end the glass fiber jacket 5 is reduced in diameter by an internally telescoped tubular coupling 5*a*, preferably formed of similar epoxy material, and connected to the cable conduit 5 by epoxy cement at the annular juncture. The reduced diameter insulating coupling 5*a* extends into the recessed upper end of the tubular shell 10 and a conical collar 13 of insulating material, such as Teflon or epoxy, slidably encircles the coupling 5a and caps the annular upper edge of the electrode 1. Preferably the annular upper edge of the tubular electrode and lower edge of the conical capping collar 13 are provided with one or more pairs of cooperable positioning ears 13*a* and notches 13*b*, as shown in the fragmentary cross-sectional detail of FIG. 2A. Externally of the insulating coupling members 5*a* and 13, we provide a tubular jacket 14 of heat shrinkable plastic insulating material which extends at its upper end over the cable conduit 5 and its lower end over the outer surface of the tubular electrode 1. The heat shrinkable tubing 14 serves to hold the coupling parts firmly in place and severely restricts, but does not prevent, seepage of water from surrounding regions into the interstices between the coupling parts.

The electrically conductive cable 4 within the insulating epoxy conduit 5 comprises one or more conductors and is connected electrically to the upper end of a conductive metallic probe or terminal stud 20. The stud 20 is threaded at 15 into the internal cavity in the electrode body 10 and includes an elongate lower end 20a extending into the body of mercury 12. An extending cylindrical upper end of the stud 20 is closely fitted in telescoping relation into the insulating coupling 5a and provided with several annular sealing rings, as resilient O-rings 21, to seal the connection between the stud and the insulating coupling 5*a*. At its upper end, and within the coupling 5*a*, the stud 20 is electrically connected to the cable 4 by soldering or brazing the cable conductors to conductive terminals 22 set into the stud 20. By way of illustration we have shown the conducting cable 4 as comprising three separately insulated conductors 23, each connected to one of the terminals 22. Preferably the conductors 23 are enclosed in a common jacket 24 of nitrile rubber or the like which is terminated above the terminal connection. As indicated at FIG. 2 the nitrile rubber jacket 24 is loosely positioned within the insulating cable conduit so that water or other fluid may be present in a tubular space 25 between the cable jacket 24 and the cable conduit 5.

In its intended use far beneath the surface of the earth the electrode 1 is subjected to high external pressure equal to the sum of any pump pressure applied to fluid in conduit 5 and the hydrostatic head between the electrode location and the surface of the earth. Since the electrode is of tubular or hollow configuration to accommodate the internal electrical connection described above, such immense external pressure, if not counterbalanced by an equal pressure applied internally, would tend to warp and distort the electrode shell 10 with consequent breaking and chipping of its protective outer coating 11.

It will be understood by those skilled in the art that in the very high ambient pressure environment contemplated (i.e., of the order of one to several thousand pounds per sq. inch) fluid electrolyte surrounding the anode shell 10 would force its way through all but the most complex fixed seals and thus into contact with interior parts. If the electrolyte did gain access to any interior part of the anode anodic corrosion would occur very rapidly. In our anode structure we avoid the need for fixed seals by filling the interior of a hollow electrode with non-corrosive fluids (including the mercury body 12) and permitting limited access of the surrounding high pressure electrolyte, but only to the extent necessary to exert pressure upon the internal fluids.

In order to counterbalance external ambient pressure upon the electrode 1 we provide means for applying a substantially equal pressure internally upon the mercury body 12 and all internal surfaces of the cavity in the electrode 1. Such internal pressure is applied by external fluid under pressure, such as formation water or pumped electrolyte, entering the unsealed lip of the capping jacket 14 and acting through the insulating fluid 32 in the interstices beneath the jacket 14 and between the upper end of the anode 10 and the insulating parts 14, 13 and 5a. To prevent direct contact of formation water with the mercury body 12 we fill the interstitial spaces above the mercury (i.e., between the anode shell 10, the insulating tube 5*a* and the insulating caps 13 and 14 with an insulating liquid 32 having a density greater than that of saline water and less than that of mercury. Such an insulating fluid, immiscible in both water and mercury, may suitably be an oleaginous derivative of freon, and preferably its upper surface is above the upper rim of the anode cavity. Thus when the conical cap 13 is pressed in place fluid 32 is forced outward through leakage paths between the shell 10 and the insulating caps 13 and 14. Desirably also, the body of mercury 12 extends above the threaded connection 15 when the probe 20, 20*a* is in place.

Internal pressure applied as described above, to the mercury body 12 is exerted through it upon the lower end of the connecting probe 20. To counterbalance such upward pressure upon the probe 20 we admit the fluid electrolyte standing in the fluid conduits 6 and 8 into the interior of the insulating cable conduit 5, as by apertures 5b in the cable conduit slightly below the transfer joint 7. Electrolyte so admitted to cable conduit 5 must be insulated from the cable terminals 22 and the stud 20. To this end we introduce into the lower end of cable conduit 5 above the stud 20 a viscous insulating fluid such as silicone grease, and drive it under pressure for a considerable distance upward into the cable conduit 5. Such insulating grease is introduced into the interior 25 of the cable conduit 5 through an inlet passage 30 in the stud 20 below the sealing rings 21 and through connecting outlet passages 31 in the stud above the sealing rings. The grease inlet passage 30 is then sealed by a suitable plug.

When our improved anode is in operative position underground with its exterior under the high hydrostatic pressure resulting from its subterranean location and from pressurization of electrolytic fluid in the conduits 6 and 8, the structure described provides two hydrostatic balance effects which relieve mechanical strain upon its parts. A first balance is between external fluid pressure and a like internal pressure on the mercury body 12. External fluid pressure is transmitted to the mercury body by fluid communication through interstices in the electrode-to-cable-conduit coupling parts and through the liquid freon in the space 32, the freon serving also to insulate the internal anode parts 10 and 20 from the external electrolyte. A second hydrostatic balance on upper and lower ends of the connecting stud 20 is effected by introducing electrolytic fluid from the fluid conduit 6 (FIG. 1) into the cable conduit 5 under substantially the same pressure head in the conduit 6, insulation of the cable terminals being provided by silicone grease in the lower end of the cable conduit 5. Upward pressure on the stud 20 is applied by the mercury body 12 and is substantially equal to external ambient pressure. Downward pressure on stud 20 is applied by the head of water in conduit 6 (admitted to the cable conduit 5 through the openings 5*b*) and thus is substantially equal to the external pressure. In this way the hollow electrode 1, provided with an internal cavity to accommodate the effective electrical connection through the probe 20-20*a*, is substantially hydrostatically balanced (1) internally and externally and (2) on upper and lower ends of the stud 20, thereby to avoid deformation, cracking and mechanical destruction due to unbalanced pressures.

As illustrated at FIG. 1, electrolytic fluid supplied through the conduits 8 and 6, preferably saline water, serves both to carry current between the electrode and the surrounding earth formation and to cool the surface of the current-conducting electrode 1. In order to ensure that this cooling electrolytic fluid uniformly bathes the entire outer surface of the long tubular electrode 1, we provide the permeable tubular enclosure 2 with small outlet apertures over the major portion of its length, thereby to so limit the radially outward flow of water that it is maintained in contact with the full length of the electrode surface. Desirably the enclosure 2 serves also to protect the electrode 1 from direct impingement of solid materials and viscous liquids, such as sand and oil, in the surrounding earth formation.

At FIG. 3 we have shown one embodiment of a control and protective enclosure 2. At FIG. 3 a fragmentary lower end of the insulating fluid conduit 6 is shown telescoped interiorally into and cemented to an insulating coupling collar 40 formed of similar epoxy glass material, and a permeable tubular basket or cup closed at the bottom and apertured for most of its length is shown suspended beneath the collar 40. The elongated tubular protective basket or cup shown at FIG. 3 comprises a tube 41 of loosely woven bands of insulating material, such as silicon glass fiber, cemented at its upper end in internally telescoped relation to the coupling collar 40 and closed at its lower end by an imperforate cup of insulating material cemented in telescoping relation to the lower end of the woven enclosure. The lower enclosing cup as illustrated at FIG. 3 comprises a relatively short length of insulating tubing 42, which may desirably be formed of epoxy glass, and an end closure cap or plug 43 at the lower end of the tube 42 and formed preferably of Teflon or similar insulating material.

The woven flow control and protective basket shown at FIG. 3 is provided externally with a plurality of spaced-apart ceramic rings 44 in close axial juxtaposition surrounding the woven tube 41 between the pipe coupling 40 and the end cup 42, 43. Each ceramic ring 44 is circumferentially grooved on its upper and lower surfaces to provide pairs of raceways in opposing relation within each of which is positioned a plurality of glass or ceramic spheres 45. The glass spheres 45 serve to maintain the rings 44 in predetermined spaced-apart relation and define between adjacent spheres and adjacent rings a plurality of permeations or restricted outlet apertures providing egress of water from interior of the basket while preventing ingress of foreign matter from outside the basket. The closed cup 42, 43 at the lower end of the basket serves to receive and store any heavy material which may undesirably gain access to the interior of the basket.

In operation, the control and protective enclosure 2 shown at FIG. 3 receives at its upper end saline water or other electrolytic cooling fluid supplied through the fluid conduit 6, and such fluid fills the annular space between the enclosure 2 and the anode 1. Because the large number of small openings provided in the enclosure 2 throughout most of its length are sufficiently small to prevent ingress of solids and restrict ingress of heavy fluids from outside the enclosure, they also limit or meter egress of electrolytic fluid from the interior. Electrolytic fluid is thus constrained to fill the entire enclosure 2 and to bathe the entire outer surface of the electrode 1 in the cooling electrolyte. The anode 1 is thereby cooled over its entire surface and maintained in conducting contact with the electrolyte over its entire surface. Current between the electrode and the electrolyte is thus maintained at the lowest possible magnitude per unit area of electrode surface, thereby to prevent localized heating and minimize electrolytic corrosion.

At FIG. 4 we have shown another embodiment of the permeable flow control and protective basket 2. As at FIG. 3 the enclosing basket is fixed to the coupling collar 40 at the lower end of the insulating fluid contact 6. In the embodiment illustrated at FIG. 4. the tubular enclosure comprises upper and lower spacing collars 50, 51 and a plurality of spaced-apart ceramic rings 52 interposed between the spacing collars in concentric, axially juxtaposed relation. Each ring 52 is planar on its lower surface and provided at its upper surface with several, for example three, lands or mesas 52a (see FIG. 4A) which serve to maintain the rings 52 in axially spaced apart relation. The lower end of the tubular basket at FIG. 4 is closed by a dirt-retaining cup, as at FIG. 3, which comprises a tube or collar 42 of insulating material, such as epoxy glass, and an end closure cap 43 of Teflon. To hold the epoxy dirt basket and the assembled rings and collars of ceramic material together, a plurality of ceramic rods 55 are cemented around the periphery of the rings and collars. The rods 55 extend lengthwise of the tubular basket enclosure in close laterally spaced apart relation. The upper ends of the rods extend beyond the upper spacing collar 50 and are telescoped over the epoxy coupling collar 40 and cemented to the collar 40 to support the protective basket.

Still another and preferred embodiment of our permeable control and protective enclosure 2 is illustrated at FIG. 5. The enclosing basket shown at FIG. 5 comprises ceramic upper and lower tubular collars 50a and 51a similar to the collars 50 and 51 shown at FIG. 4, but having inwardly facing portions of reduced external cross section, as at 50b and 51b, respectively. Peripherally disposed around these inwardly offset collar sections and extending axially between them is a plurality of ceramic rods 55 similar to the rods 55 shown at FIG. 4. The rods 55 of FIG. 5, as at FIG. 4, are sufficient in number so that they are laterally closely adjacent each other but leave restricted spaces or permeations therebetween. The rods 55 are cemented to the inset collar portions **50*b* and 51*b* to form the enclosure. To further support and position the rods 55 in the embodiment of FIG. 5 we provide a plurality of ceramic garter rings 56 surrounding the rods 55 at axially spaced apart intervals. The axially remote end rings 56 are preferably placed over the inset collar portions 50*b* and 51*b*. The intermediate garter rings 56 are backed up internally by positioning rings 57 encircling the inner periphery of the rods 55, each in juxtaposition to an outer ring 56. The inner positioning rings 57** are also formed of ceramic material.

If desired some or all of the intermediate garter rings 56 and positioning ring 57 of FIG. 5 may be omitted. Also, it may be found desirable to surround a cage formed of such ceramic rods 55 with one or more additional coaxial cages of larger dimensions.

The ceramic material preferably utilized in those parts so identified at FIGS. 3, 4, and 5, is a high purity anhydrous aluminum oxide $Al_2O_3$, i.e., alumina. The long pencil-like rods of this material identified at 55 in FIGS. 4 and 5 are slightly flexible. In the embodiment of FIG. 5 this flexibility enables the rods to flex slightly outward between axially spaced tie points, thereby to relieve surges of excessive internal pressure.

While we have shown and described by way of illustration certain preferred embodiments of our invention, many modifications will occur to those skilled in the art, and we therefore wish to have it understood that we intend in the appended claims to cover all such modifications as fall within the true spirit and scope of our invention.

What we claim and desire to secure by Letters Patent of the United States is:

1. In a deep submersible power electrode assembly for direct underground installation exposed to a surrounding mixture of saline and oleaginous fluids under a hydrostatic pressure head of the order of at least several hundred feet, the combination comprising an imperforate elongate electrode body having a current conducting terminal and an exposed outer surface adapted to be traversed by current flowing between said body and said fluid mixture, a permeable tubular enclosure of insulating material loosely surrounding said electrode body and defining an annular space therebetween, said enclosure having permeability sufficiently small significantly to inhibit flow of said oleaginous fluid toward said electrode body but large enough to permit limited egress of saline water from said enclosure, and means including a supply conduit for introducing saline water into said annular space at one end of said enclosure and maintaining said water under pressure greater than said hydrostatic pressure of the fluid mixture outside said enclosure, whereby the limited egress of saline water through said permeable enclosure constrains said saline water to fill substantially the full length of said annular space thereby to cool the outer surface of said electrode body and to conduct current at minimum surface density from said outer surface to said surrounding fluid mixture.

2. An electrode assembly according to claim 1 wherein said permeable tubular enclosure comprises a loosely woven tube formed of insulating tape and an imperforate cap closing the bottom of said tube.

3. An electrode assembly according to claim 1 wherein said permeable tubular enclosure comprises a plurality of rings of ceramic material axially stacked together in closely spaced relation with annular apertures therebetween.

4. An electrode assembly according to claim 3 wherein said rings are circumferentially grooved on opposing faces and are held in axially spaced-apart relation by a plurality of balls of insulating material disposed in closely spaced juxtaposition in each opposing pair of said grooves.

5. An electrode assembly according to claim 1 wherein said permeable enclosure comprises a loosely woven tube of insulating tape, a plurality of ceramic rings closely surrounding said tube in closely spaced axial juxtaposition, and an end cap fixed to the lowermost said ring.

6. An electrode assembly according to claim 1 wherein said permeable enclosure comprises a plurality of rods of ceramic material laterally juxtaposed in closely spaced relation to form a tubular envelope, a pair of ceramic positioning rings fixed to opposite ends of said rods, and at least one ceramic garter ring encircling said rods at an axially intermediate point.

7. An electrode assembly according to claim 6 including a closure cap of insulating material fixed to the lowermost said positioning ring.

8. An electrode assembly according to claim 6 wherein said ceramic material comprises high purity alumina.

9. An electrode assembly according to claim 1 wherein said permeable enclosure comprises a plurality of high purity alumina components assembled together in closely spaced relation to provide restricted fluid apertures therebetween.

10. A power conveying underground anode assembly adapted to conduct electric current over extended time periods and in contact with a mixture of saline water and oleaginous fluids under a hydrostatic pressure head of the order of at least several hundred feet, said assembly comprising, an elongate tubular body of electrically conductive material having an exposed current conducting outer surface extending for substantially its full length and an internal axial recess at one end, a conductive fluid substantially filling said recess, means including a terminal stud extending into said conductive fluid for electrically connecting said body to a source of electric current supply, means responsive to the high hydrostatic pressure of said fluid mixture outside said tubular body for maintaining said conductive fluid under substantially equal pressure, a permeable enclosure of insulating material loosely surrounding said electrode body and defining an annular space therebetween, said enclosure being provided over a major portion of its surface with permeations sufficiently large to permit limited egress of saline water and sufficiently small to inhibit ingress of solid material and oleaginous fluids, and means for introducing saline water into said annular space in the region of one axial end thereof and maintaining said water under pressure greater than said hydrostatic pressure, whereby the limited egress of saline water constrains said saline water to bathe substantially the entire exposed surface of said electrode body thereby to cool said body and to distribute flow of electric current into said water over substantially the entire outer surface of said body.

11. A power conveying anode assembly according to claim 10 wherein the exposed outer surface of said tubular body comprises an external coating of lead dioxide.

12. A power conveying anode assembly according to claim 10 wherein said tubular body has a length of the order of about 5 to 50 times its greatest cross-sectional dimension and a coating of lead dioxide on its outer surface.

13. In combination with a power conveying anode assembly according to claim 2 wherein said permeable enclosure comprises a plurality of axially juxtaposed ceramic rings in close axially spaced relation with a ceramic closure cap at one end, a cable conduit of insulating material connected to the open end of said tubular body in supporting relation, and a fluid supply conduit surrounding said cable conduit and connected to the open end of said permeable enclosure.

14. In combination with a power conveying anode assembly according to claim 2 wherein said permeable enclosure comprises a plurality of laterally juxtaposed ceramic rods forming a tubular envelope and having a ceramic closure cap at one end thereof, a cable conduit of insulating material connected to the open end of said tubular body in supporting relation, and a fluid supply conduit surrounding said cable conduit and connected to the open end of said permeable enclosure.

15. In a deep submersible power electrode for direct underground installation exposed to a surrounding mixture of saline fluid under a hydrostatic pressure head of the order of at least several hundred feet, the combination comprising an elongate conductive body adapted for disposition with its axis substantially vertical and having an internal axial recess open at the top end thereof, a body of mercury in said recess, electric terminal means including a conductive stud fixed in said recess and extending into said mercury body, closure means covering the open end of said recess and providing access for a connecting cable, said closure means and conductive body having no fixed seal therebetween thereby to provide interstitial fluid communication between said recess and the exterior of said conductive body, and a body of insulating liquid floated on said mercury body and filling the interstices between said closure means and said conductive body thereby to seal said interstices against entrance of external saline fluid under pressure and to transmit the external pressure on said saline fluid to said mercury body, whereby hydrostatic pressure applied to the outer surface of said electrode body is balanced by a substantially equal pressure applied internally through said mercury body.

16. In combination with a power electrode according to claim 15 wherein said conductive stud is fixed in said recess and includes an extended upper end, a tubular cable conduit of insulating material fitted over said upper end in sealed telescoping relation, and a body of fluid in said cable conduit under hydrostatic pressure substantially equal to that applied to said mercury body.

17. A power electrode and cable conduit according to claim 7 wherein said electrode includes a body of insulating grease within said conduit interposed between the fluid under pressure contained therein and said connecting stud.

18. A power electrode according to claim 15 wherein said elongate conductive body is formed of graphite and coated externally with a layer of lead dioxide.

19. In combination with an underground electrode according to claim 15, a cable conduit of insulating material extending through said closure means, and means connecting said conduit to said conductive body in supporting relation.

20. In combination with a power electrode according to claim 15 wherein said conductive stud extends in said recess above and below its points of connection to said conductive body, the upper end of said stud extending toward the upper open end of said recess, a cable conduit entering said recess and sealed in telescoping relation to the upper end of said stud, a fluid supply conduit surrounding said cable conduit in radially spaced relation, a permeable tubular enclosure loosely surrounding said electrode, and means coupling said permeable enclosure to the lower end of said fluid supply conduit.

* * * * *